US011521521B2

(12) United States Patent
Chung et al.

(10) Patent No.: US 11,521,521 B2
(45) Date of Patent: Dec. 6, 2022

(54) DISPLAY APPARATUS

(71) Applicant: SAMSUNG ELECTRONICS CO., LTD., Suwon-si (KR)

(72) Inventors: Woosung Chung, Suwon-si (KR); Beomkyun Rha, Suwon-si (KR); Kibum Seong, Suwon-si (KR); Seongwook Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 63 days.

(21) Appl. No.: 17/133,250

(22) Filed: Dec. 23, 2020

(65) Prior Publication Data

US 2021/0201713 A1 Jul. 1, 2021

Related U.S. Application Data

(60) Provisional application No. 62/954,250, filed on Dec. 27, 2019.

(30) Foreign Application Priority Data

Feb. 17, 2020 (KR) ..... 10-2020-0018863

(51) Int. Cl.
*G09F 9/30* (2006.01)

(52) U.S. Cl.
CPC ..... *G09F 9/301* (2013.01)

(58) Field of Classification Search
CPC ..... G09F 9/301; G09F 11/21; G06F 1/1641; G06F 1/1652; G06F 2203/04102
See application file for complete search history.

(56) References Cited

U.S. PATENT DOCUMENTS

| | | | |
|---|---|---|---|
| 9,478,157 | B2 | 10/2016 | Wu et al. |
| 9,756,757 | B2 | 9/2017 | Park et al. |
| 9,817,443 | B2 | 11/2017 | Kim |
| 9,864,412 | B2 | 1/2018 | Park et al. |
| 9,947,259 | B2 | 4/2018 | Wu et al. |
| 10,201,103 | B2 | 2/2019 | Kim et al. |
| 10,492,607 | B2 | 12/2019 | Choi et al. |
| 10,606,362 | B2 | 3/2020 | Chung |
| 10,671,124 | B2 | 6/2020 | Kim et al. |

(Continued)

FOREIGN PATENT DOCUMENTS

| | | | |
|---|---|---|---|
| CN | 109788092 | A | 5/2019 |
| EP | 3702880 | A1 | 9/2020 |

(Continued)

OTHER PUBLICATIONS

International Search Report (PCT/ISA/210) and Written Opinion (PCT/ISA/237) dated Apr. 14, 2021 issued by the International Searching Authority in International Application No. PCT/KR2020/018662.

*Primary Examiner* — Joe H Cheng
(74) *Attorney, Agent, or Firm* — Sughrue Mion, PLLC

(57) ABSTRACT

A display apparatus including a housing provided with an opening; a first roll and a second roll provided in the housing and spaced apart from each other; and a display configured to be wound around the first roll and the second roll, and configured to be extracted out from the housing and retracted into the housing through the opening. The housing includes a transparent area configured to expose the display within the housing.

12 Claims, 11 Drawing Sheets

(56) References Cited

U.S. PATENT DOCUMENTS

| | | | | |
|---|---|---|---|---|
| 2007/0211036 | A1* | 9/2007 | Perkins | G06F 3/0412 345/173 |
| 2008/0086925 | A1* | 4/2008 | Yang | H04M 1/0268 40/610 |
| 2008/0144265 | A1* | 6/2008 | Aoki | G06F 1/1641 361/679.04 |
| 2009/0051830 | A1* | 2/2009 | Matsushita | G06F 1/1652 361/679.05 |
| 2009/0237872 | A1* | 9/2009 | Bemelmans | G06F 1/1684 361/679.01 |
| 2012/0002357 | A1* | 1/2012 | Auld | G09F 9/301 361/679.01 |
| 2013/0058063 | A1* | 3/2013 | O'Brien | G06F 1/1624 361/807 |
| 2014/0194165 | A1* | 7/2014 | Hwang | G06F 1/1652 455/566 |
| 2015/0116921 | A1* | 4/2015 | Hsu | G06F 1/1624 361/679.27 |
| 2016/0140889 | A1 | 5/2016 | Wu et al. | |
| 2016/0170450 | A1* | 6/2016 | Kim | G06F 1/166 361/807 |
| 2016/0202729 | A1* | 7/2016 | Lee | H05K 5/0017 361/749 |
| 2016/0216737 | A1* | 7/2016 | Hayk | G06F 1/1626 |
| 2017/0031387 | A1 | 2/2017 | Kim | |
| 2017/0039925 | A1 | 2/2017 | Wu et al. | |
| 2017/0196102 | A1* | 7/2017 | Shin | G06F 1/1607 |
| 2017/0325342 | A1* | 11/2017 | Lee | G09G 3/001 |
| 2019/0150300 | A1 | 5/2019 | Kim et al. | |
| 2020/0209924 | A1 | 7/2020 | Zuo | |
| 2020/0320907 | A1 | 10/2020 | Yamamoto et al. | |
| 2020/0365063 | A1 | 11/2020 | Park et al. | |
| 2021/0014982 | A1 | 1/2021 | Bok et al. | |

FOREIGN PATENT DOCUMENTS

| | | | |
|---|---|---|---|
| JP | 3135213 | U | 9/2007 |
| KR | 10-0648150 | B1 | 11/2006 |
| KR | 1020160058669 | A | 5/2016 |
| KR | 1020160148141 | A | 12/2016 |
| KR | 1020160150253 | A | 12/2016 |
| KR | 1020170073958 | A | 6/2017 |
| KR | 101758835 | B1 | 7/2017 |
| KR | 1020170087764 | A | 7/2017 |
| KR | 1020180026944 | A | 3/2018 |
| KR | 1020190062855 | A | 6/2019 |
| KR | 1020190083687 | A | 7/2019 |
| KR | 102025924 | B1 | 9/2019 |
| KR | 10-2020-0133136 | A | 11/2020 |
| KR | 10-2021-0007082 | A | 1/2021 |
| WO | 2017094926 | A1 | 6/2017 |
| WO | 2019111576 | A1 | 6/2019 |

* cited by examiner

DISPLAY APPARATUS

CROSS-REFERENCE TO RELATED APPLICATION

This application is based on and claims priority under 35 U.S.C. § 119 to Korean Patent Application No. 10-2020-0018863, filed on Feb. 17, 2020, in the Korean Intellectual Property Office, and U.S. Provisional Application Ser. No. 62/954,250, filed on Dec. 27, 2019, in the U.S. Patent and Trademark Office, the disclosures of which are incorporated by reference herein in their entireties.

BACKGROUND

1. Field

The disclosure relates to a display apparatus, and more particularly, to a display apparatus including a housing storing a rollable display which may display a screen through the housing.

2. Description of Related Art

While electronic apparatuses having a display apparatus are being miniaturized, there are many consumers demanding large scale screens.

Accordingly, display apparatuses have been developed to include a rollable display, and the display is unwound and used when a user uses the display apparatus, and the display is wound to a roll and stored inside the housing when not in use.

However, there is the problem of not being able to utilize the housing stored with the rollable display as a screen, and a low degree of freedom to the housing design which accommodates one roll.

SUMMARY

According to an aspect of the disclosure, a display apparatus may include a housing provided with an opening; a first roll and a second roll provided in the housing and spaced apart from each other; and a display configured to be wound around the first roll and the second roll, and configured to be extracted out from the housing and retracted into the housing through the opening. The housing may include a transparent area configured to expose the display within the housing.

The display may be configured to be wound around the first roll and the second roll with an image outputting surface facing outward with respect to the rolls.

The display apparatus may further include a driving circuit provided within the housing. The driving circuit may be connected to one end of the display through wiring.

The display apparatus may further include a link member including a first arm rotatably connected to the housing; and a second arm having a first end connected to the display and a second end to rotatably connect to one end of the first arm. The wiring of the driving circuit may be disposed along the link member.

The display apparatus may further include a driving circuit disposed between the first roll and the second roll. The driving circuit may be configured to connect with an end of the display through wiring.

The display may further include a processor configured to control the display to output an image at a location corresponding to the transparent area as the display is being retracted into or extracted out from the housing.

The display apparatus may further include a sensor configured to detect at least one of a surrounding illuminance of the display apparatus and a user location; and a processor configured to control the display to output a predetermined image through the transparent area based on information detected by the sensor.

The transparent area may be provided on a portion of a front-surface and a portion of top-surface of the housing.

The transparent area may be provided by the housing being opened or includes a transparent material.

The transparent area includes a first transparent area which is provided at a front-surface of the housing and a second transparent area which is provided at a rear-surface of the housing.

The display apparatus may further include a sensor configured to detect a wall located behind a rear of the display apparatus; and a processor configured to control, based on the sensor detecting the wall, the display to output a color corresponding to an image output toward a front of the display to the second transparent area.

The display apparatus may further include a third roll and a fourth roll spaced apart within the housing. The display may include a first display configured to be wound around the first roll and the second roll, and a second display configured to be wound around the third roll and the fourth roll.

The transparent area may include a first transparent area configured to expose an area of the first display and a second transparent area configured to expose an area of the second display.

BRIEF DESCRIPTION OF THE DRAWINGS

The above and other aspects, features, and advantages of certain embodiments of the present disclosure will be more apparent from the following description, taken in conjunction with the accompanying drawings, in which.

DETAILED DESCRIPTION

Figure 1:
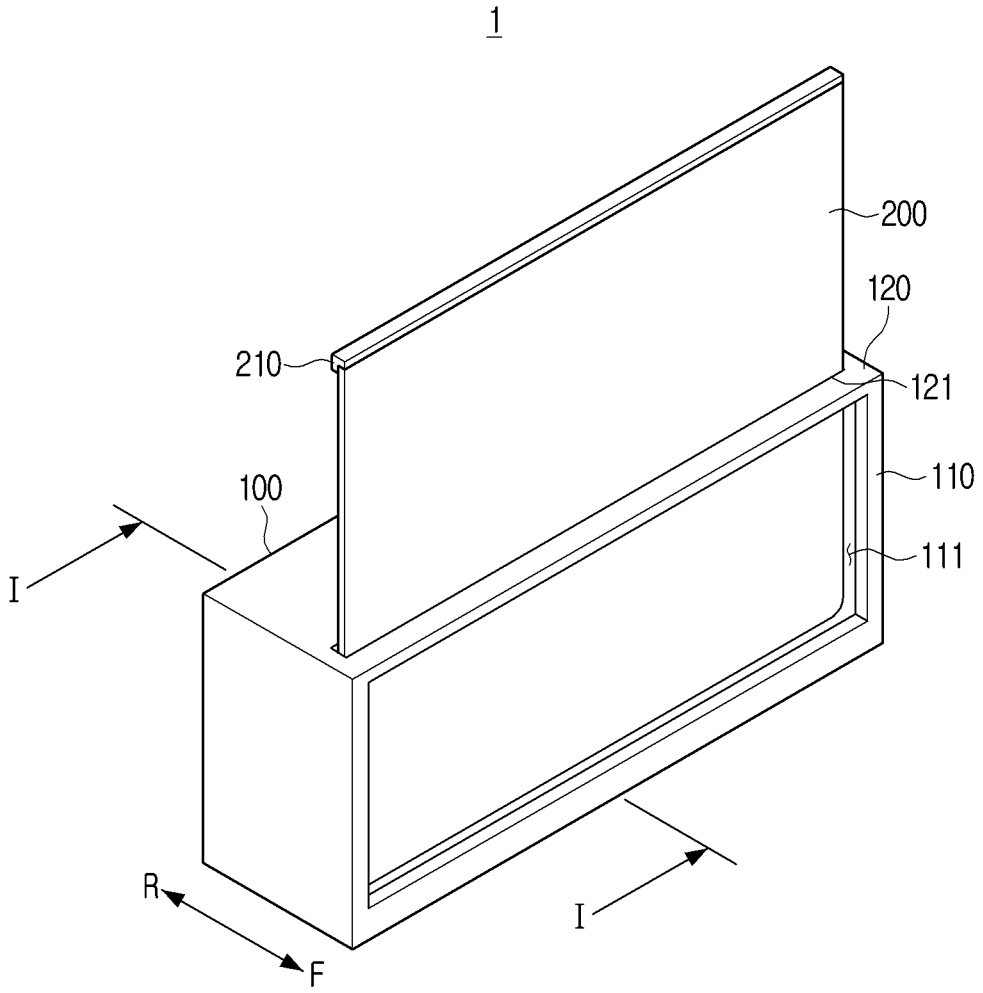
FIG. 1 is a perspective view of a display apparatus according to an embodiment.

Embodiments described herein are provided as examples to assist in the understanding of the disclosure, and various modifications may be made to and practiced. However, in describing the disclosure, in case it is determined that the detailed description of related known technologies may unnecessarily confuse the gist of the disclosure, the detailed description and detailed drawing will be omitted. In addition, it should be noted that the accompanied drawing is not illustrated to an actual scale but dimensions of some elements may be exaggeratedly illustrated to assist in the understanding of the disclosure.

The terms used in the disclosure and the claims are general terms identified in consideration of the functions of the various embodiments of the disclosure. However, these terms may vary depending on intention, legal or technical interpretation, emergence of new technologies, and the like of those skilled in the related art. Also, there may be some terms arbitrarily identified by an applicant. Unless there is a specific definition of a term, the term may be construed based on the overall contents and technological common sense of those skilled in the related art.

It is to be understood that expressions such as "comprise," "may comprise," "include," or "may include" are used herein to designate a presence of a corresponding characteristic (e.g., element such as a number, a step, an operation, a component, or the like), and not to preclude a presence or a possibility of additional characteristics.

The terms such as "first," "second," and so on may be used to describe a variety of elements, but the elements should not be limited by these terms. The terms are used only for the purpose of distinguishing one element from another. For example, without exceeding the scope of protection, a first element may be designated as a second element and likewise, a second element may also be designated as a first element.

In addition, terms such as 'front-surface,' 'rear-surface,' 'top-surface,' 'bottom-surface,' 'side-surface,' 'left-surface,' 'right-surface,' 'upper-part,' 'lower-part,' or the like used in the disclosure have been defined based on the drawings, and the shape and position of each element may not be limited by these terms.

Further, because the disclosure describes elements necessary in the description of each embodiment, the embodiments are not necessarily limited thereto. Accordingly, some elements may be modified or omitted, and other elements may be included. In addition, the elements may be dispersed and disposed in devices which are independent from one another.

Further, although the embodiments of the disclosure have been described with reference to the accompanying drawings and the descriptions disclosed in the accompanying drawings, the disclosure is not limited to the specific embodiments described herein.

The disclosure provides a display apparatus including a housing storing a rollable display which may be displayed through the housing.

Figure 2:
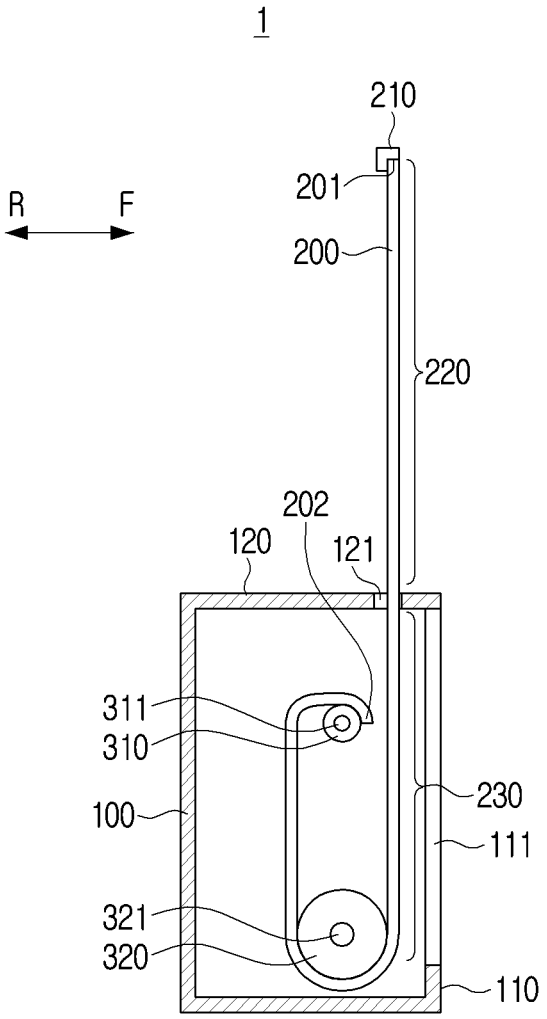
FIG. 2 is a cross-sectional view taken along line I-I of the display apparatus illustrated in FIG. 1 according to an embodiment.
Figure 3:
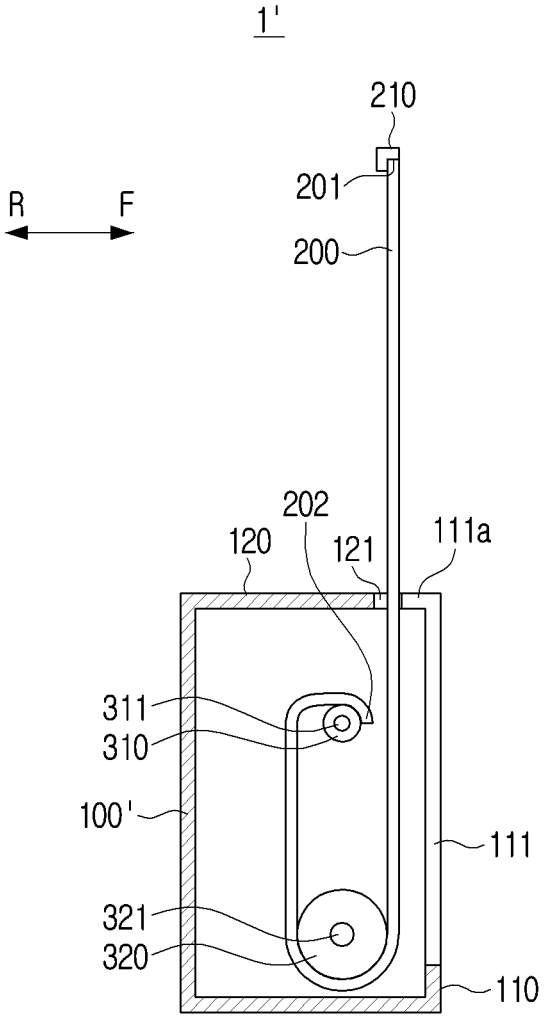
FIG. 3 is a cross-sectional view of a display apparatus according to another embodiment.

FIG. 1 is a perspective view illustrating schematically a display apparatus 1 according to an embodiment. FIG. 2 is a cross-sectional view taken along line I-I of the display apparatus 1 illustrated in FIG. 1. FIG. 3 is a cross-sectional view illustrating a transparent area 111 expanded in the display apparatus 1' according to an embodiment.

Referring to FIGS. 1 and 2, the display apparatus 1 according to an embodiment may include a housing 100, a display 200, a first roll 310 and a second roll 320, and may be configured to roll the display 200 inti the housing 100. The display apparatus 1 may provide information to the user by extracting the display to the outside of the housing 100.

The display apparatus 1 according to various embodiments may be an electronic device including an image display function, a piece of furniture, or a part of a building or structure. For example, the display apparatus 1 may include at least one of a television, a digital video disk (DVD) player, a smartphone, a desktop personal computer (PC), a tablet PC, a laptop PC, a personal digital assistant (PDA), a portable multimedia player (PMP), an MP3 player, a mobile medical device, a camera, a wearable device (e.g., electronic glasses, smart watch, etc.), a TV box (e.g., a SAMSUNG HomeSync™, an APPLE TV™, or a GOOGLE TV™), a game console, an electronic board, an electronic signature receiving device, a projector, or various measurement devices (e.g., water meter, electric meter, gas meter, wave meter, etc.).

The housing 100 may form an exterior of the display apparatus 1, and may include a metal or plastic material. In addition, the housing 100 may generally have an rectangular parallelepiped shape, but is not limited thereto, and the material, size, and shape of the housing 100 may be provided in various forms.

The housing 100 may accommodate a display 200 inside itself and may include an opening 121 at the top-surface 120 for the display 200 to be extracted outside of the housing 100. That is, the display 200 may be extracted and retracted through the opening 121 of the housing 100.

The housing 100 may include a transparent area 111 formed by an area of a front-surface 110 being opened so that an area of the display 200 accommodated within the housing 100 may be exposed to the outside. However, the transparent area 11 is not limited thereto, and may be formed of a transparent material such as glass.

The transparent area 111 may be formed at a portion of the front-surface 110 of the housing 100, but is not limited thereto, and as shown in FIG. 3, one end 111*a* of the transparent area 111 may be extended to a portion of the top-surface 120 of the housing 100'.

The display 200 may display various content (e.g., texts, images, videos, icons, symbols, etc.) to the user. The display 200 may include, for example, and without limitation, a liquid crystal display (LCD), a light-emitting diode (LED) display, organic light-emitting diode (OLED) display, a microelectromechanical systems (MEMS) display, an electronic paper display, or a flexible display where the display part may be bent or curved.

The display 200 may be connected to a top frame 210 at a first end 201 and connected to a first roll 310 at an opposite second end 202. The surface to which image is output may be wound to face outward on the first and second rolls 310 and 320. The top frame 210 may be coupled to the one end 201 of the display 200, and supported by a link member 800 (FIG. 9), which will be described below, for the display 200 to be stably retracted and extracted.

The display 200, when in the extracted states shown in FIGS. 2 and 3, may include a first display area 220 which is located to the outside of the housing 100 and a second display area 230 which is exposed through the transparent area 111. In addition, the display 200 may not output an image throughout an entire area, and may include an area to which an image is not output from a point at which the second display area 230 ends to the second end 202 which is connected to the first roll 310, and the area may be formed of various material such as fabric and plastic.

In addition thereto, as shown in FIG. 3, due to the one end 111*a* of the transparent area 111 extending to a portion of the top-surface 120 of the housing 100', and because the display 200 is not divided into the first and second display areas 220 and 230 by the housing 100', the user may view images of various ratios through one large screen seamlessly.

The first and second rolls 310 and 320 may be spaced apart from each other within the housing 100 and the display 200 may be rolled around the first and second rolls 310 and 320. In addition, each rotation shaft 311 and 321 of the first and second rolls 310 and 320 may be rotatably supported in the housing 100, and may be configured to cause the display 200 to be retracted or extracted based on rotating in a forward direction or a reverse direction. Although, two rolls have been illustrated as being provided within the housing 100, the number of the rolls is not limited thereto.

When the rotation shafts 311 and 321 of the first and second rolls 310 and 320 rotate in one direction, the display 200 may be wound up on the first roll 310 and retracted within the housing 100, and when the rotation axes of the first and second rolls 310 and 320 rotate in an opposite direction, the display wound up on the first roll 210 may be unwound and extracted to the outside of the housing 100.

Based on the first and second rolls 310 and 320 being spaced apart from each other within the housing 100, because the second display area 230 is exposed to the outside through the transparent area 111, the front-surface of the housing 100 may be utilized as a screen. In addition, because the housing 100 may accommodate a plurality of rollers 310 and 320 within, the size and design may be variously formed compared to when one roller is accommodated.

Figure 4:
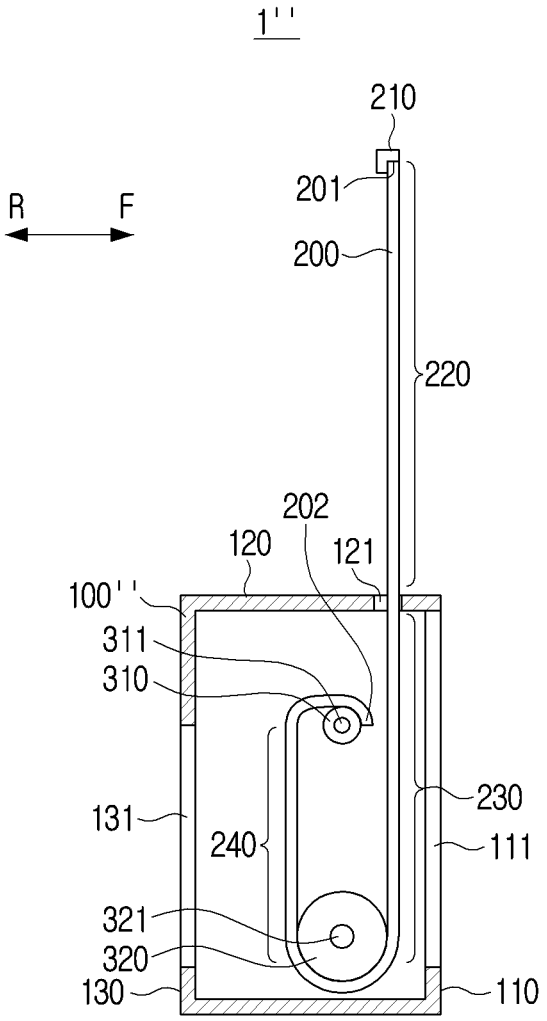
FIG. 4 is a cross-sectional view of a display apparatus according to another embodiment.
Figure 5:
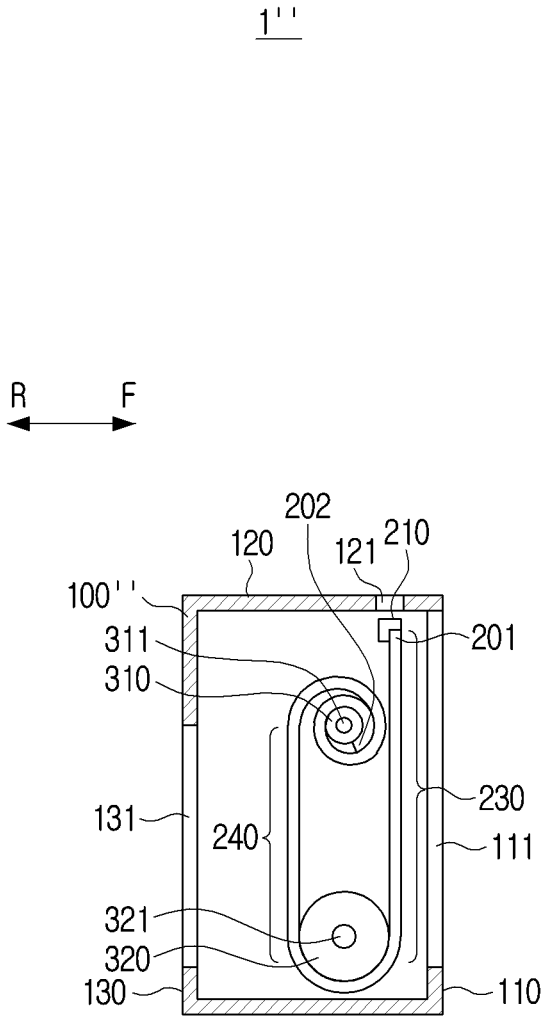
FIG. 5 is a cross-sectional view of a display being retracted in the display apparatus illustrated in FIG. 4.

FIG. 4 is a cross-sectional view showing a second transparent area 131 being provided on the display apparatus 1". FIG. 5 is a cross-sectional view showing a display 200 being retracted in the display apparatus 1" shown in FIG. 4.

Referring to FIGS. 4 and 5, the display apparatus 1 may include the first transparent area 111 formed at the front-surface 110 of the housing 100, and also a second transparent area 131 formed at the rear-surface 130. The second transparent area 131 may be provided by one area of the housing 100" being opened like the above-described first transparent area 111 or may be formed of a transparent material such as glass.

Based on the second transparent area 131 being provided at the rear-surface 130 of the housing 100", a third display area 240 that may be located adjacent to the rear-surface 130 of the housing 100" may be exposed through the second transparent area 131. That is, even if an additional display 200 is not included in the display apparatus 1, the rear-surface 130 of the housing 100" may be utilized as a screen.

In addition, as shown in FIG. 5, when the display 200 extracted out of the housing 100", and also when the display is retracted within the housing 100, because the second and third display areas 230 and 240 are exposed respectively through the first and second transparent areas 111 and 131 formed in the housing 100", an image may be output by the housing 100" itself.

The third display area 240 may output an image different from the first or second display area 220 or 230 toward the rear R of the display apparatus 1. In this case, a user located at a front F of the display apparatus 1 may hear sound through a speaker of the display apparatus 1, and a user located at a rear R of the display apparatus 1 may hear sound corresponding to an image output from the third display area 240 through a wireless earphone, a speaker provided within a remote controller, or an artificial intelligence speaker.

Although the display apparatus 1 according to an embodiment has been illustrated as the display 200 being extracted only from the lower side to the upper side, embodiments are not limited thereto, and the display 200 may be extracted from a left-side to a right-side. Based on the display apparatus 1 being used as an electronic blackboard, or the like, a class or a meeting content may be output to the transparent area, and if an expansion of the display 200 is necessary, the display 200 may be expanded from the left-side to the right-side and may use a wider area as the electronic blackboard.

Figure 6:
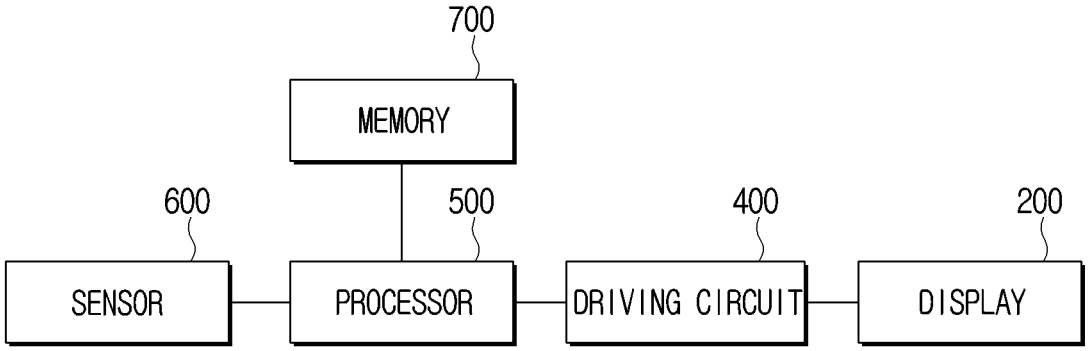
FIG. 6 is a hardware diagram of a display apparatus according to an embodiment.

FIG. 6 is a hardware diagram of a display apparatus 1 according to an embodiment. The driving circuit 400, processor 500, sensor 600 and memory 700 shown in FIG. 6 may be included in the display apparatus 1.

Figure 9:
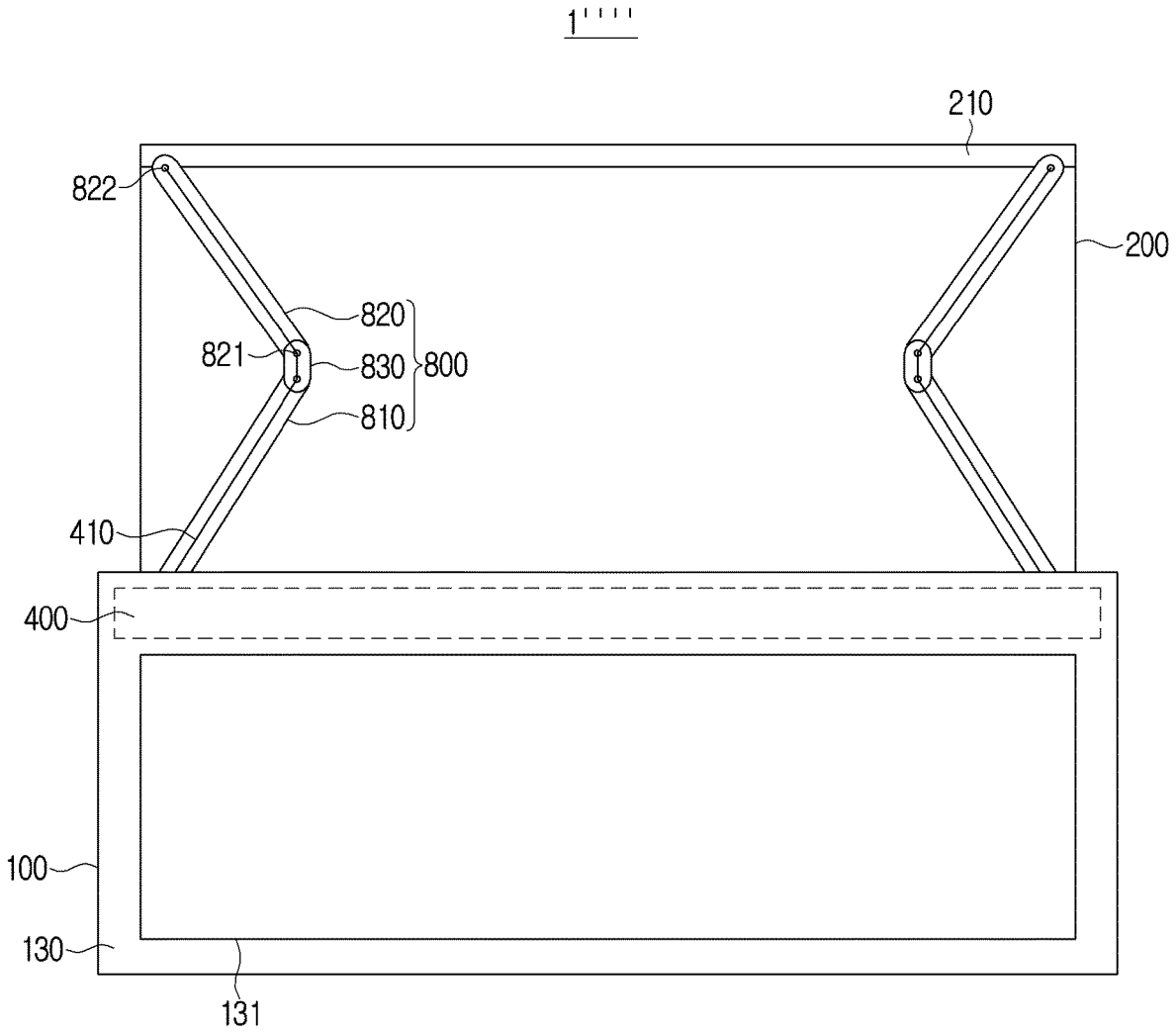
FIG. 9 is a rear view of the display apparatus illustrated in FIG. 8.

The driving circuit 400 may be configured to change the data transmitted from the processor 500 to a form transferrable to the display 200, and may transmit the changed data to the display 200 through wiring 410 (FIG. 9).

The processor 500 may control the overall operation of the display apparatus 1. Specifically, the processor 500 may be implemented as an integrated circuit (IC), a system on chip (SoC), or a mobile application processor (AP), and may transmit data (e.g., image data, moving image data, or still image data) to be displayed to the driving circuit 400.

The sensor 600 may include a plurality of sensors, and may detect at least one from among a wall located at the rear R of the display apparatus 1, a surrounding illuminance, and user information (e.g., location, voice, temperature, or the like of the user), and transmit the detected data to the processor 500. The processor 500 may be configured to, through the data received from the sensor 600, control an operation of the display apparatus 1 with a predetermined algorithm stored in the memory 700.

The control process of the display apparatus 1 according to the various embodiments will be described in detail below.

The processor 500 may be configured to, based on the display 200 being retracted in or extracted from the housing 100, control the display 200 for an image output to the transparent area 111 to be constant. When the sensor 600 detects a retraction signal or an extraction signal, or detects a rotation direction or speed of the rolls 310 and 320, the processor 500 may control the display 200 to cause the image output to the transparent area 111 to be moved in an opposite direction than the movement direction of the display 200 so the image output through the transparent area is output at the same continuous location.

Accordingly, because the user may continuously view the constant image being output through the transparent area 111 while maintaining eyesight even if the display 200 is retracted in or extracted from the housing 100, the display apparatus 1 according to an embodiment may provide a more comfortable viewing environment to the user.

The display 200 may output an image including information such as weather, time, news, or the like through the transparent area 111. In addition, the sensor 600 may detect at least one from among a face, iris or fingerprint of the user, and the processor 500 may be configured to compare the detected data with user information stored in the memory 700 and control the display 200 to output customized information (e.g., schedule, recommended news, music, image, etc. of the user) according to the user through the transparent area 111.

The sensor 600 may detect at least one from among the surrounding illuminance of the display apparatus 1 and the user location, and the processor 500 may control the display 200 to output a predetermined image to the transparent area 111 according to the information detected by the sensor 600. Specifically, the processor 500 may be configured to control the display 200 to output an image to one area from among the first or second transparent area 111 or 131 toward the user based on the detected user location.

Based on the surrounding illuminance of the display apparatus 1 detected by the sensor 600 being low, the processor 500 may be configured to control the display 200 to output lighting to one area from among the first or second transparent area 111 or 131 toward the user based on the detected user location. Accordingly, the display 200 may perform a role as a mood-light.

The sensor 600 may detect a wall located at the rear R of the display apparatus 1, and the processor 500 may control the display 200 so the color corresponding to the image output to the front F of the display 200 is output to the second transparent area 131 when the sensor 600 detects a wall.

The processor 500 may control the display 200 so one pixel of the third display area 240, which is proximate to a one pixel which is output to the front F, to output a color identical or similar to a color of a one pixel which is output to the front F. Accordingly, the color output to the rear by the third display area 240 may be reflected by the wall, and recognized by the user located at the front F. The display apparatus 1 according to an embodiment of the disclosure may, even without including a separate additional display 200, enhance a stereoscopic effect of an image that is output to the front F and increase viewing immersiveness of the user according to an effect of the screen appearing larger.

Figure 7:
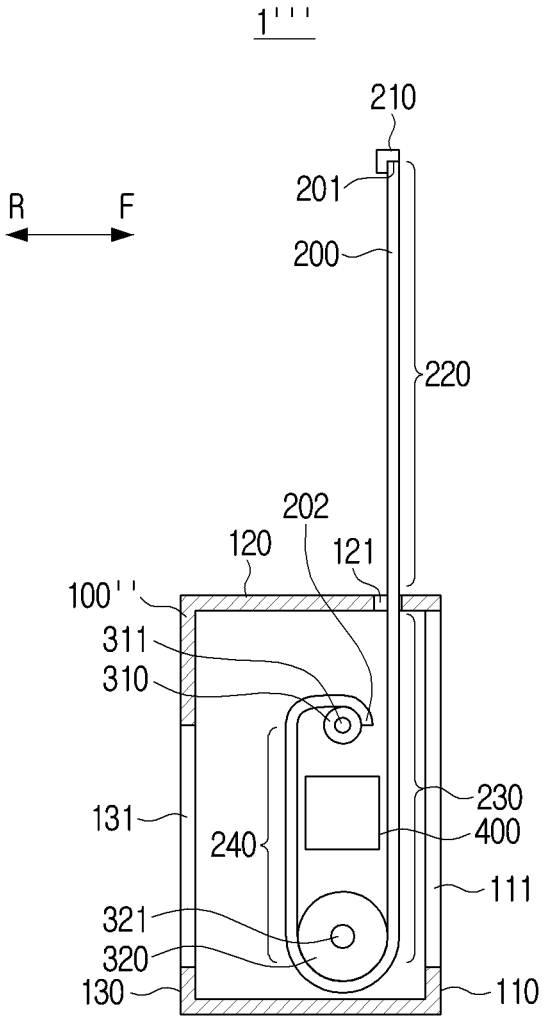
FIG. 7 is a cross-sectional view of the display apparatus illustrated in FIG. 4 showing a position of the driving circuit according to an embodiment.
Figure 8:
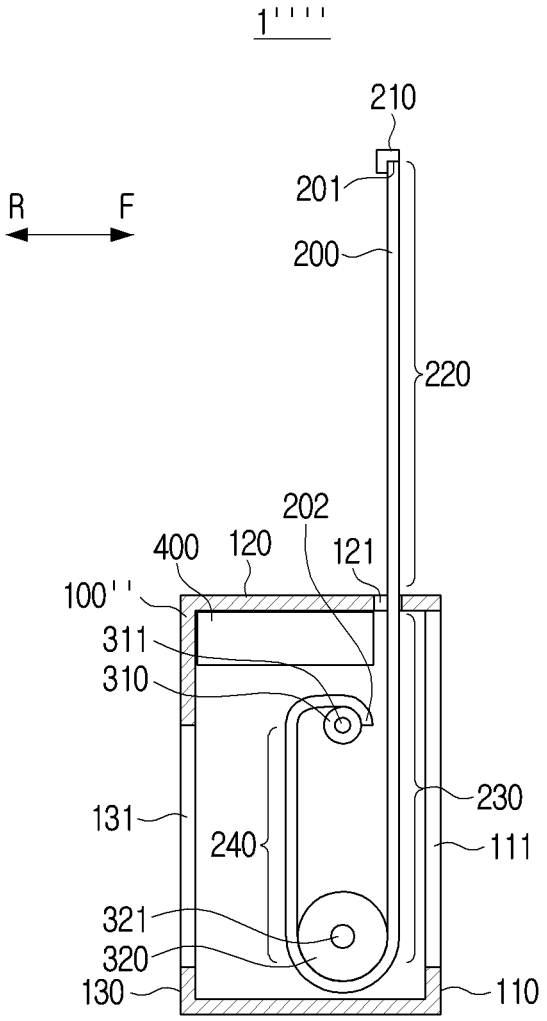
FIG. 8 is a cross-sectional view of the display apparatus illustrated in FIG. 4 showing a position of the driving circuit according to another embodiment.

FIG. 7 is a cross-sectional view showing a driving circuit 400 of the display apparatus 1''' according to an embodiment. FIG. 8 is a cross-sectional view showing a driving circuit 400 of the display apparatus 1'''' according to another embodiment FIG. 9 is a rear view of the display apparatus 1'''' shown in FIG. 8.

Referring to FIG. 7, the driving circuit 400 may be disposed between the first and second rolls 310 and 320. Due to the driving circuit 400 be provided in a space between the rolls 310 and 320, a display apparatus 1''' with a more compact shape may be implemented.

The driving circuit 400 may be connected with the second end 202 of the display 200 through wiring, and may transmit various data to the display 200. When the display 200 may be maximally extracted, the length of the wiring connecting the driving circuit 400 with the display 200 may be variously set according to which point of the first roll 310 the other end 202 of the display 200 is located.

Referring to FIGS. 8 and 9, the driving circuit 400 may be disposed at the upper-part within the housing 100''. However, the location of the driving circuit 400 is not limited thereto, and may be disposed at the lower-part within the housing 100''. The driving circuit 400 disposed at the upper-part or lower-part within the housing 100'' may be connected to one end 201 of the display 200 through wiring 410.

Based on the driving circuit 400 being disposed as described above, because the wiring 410 may be disposed regardless of the rotation of the roll 300 and connect the display 200 with the driving circuit 400, the display 200 may be more stably connected to the driving circuit 400 for receiving transmission of data.

The top frame 210 of the display 200 may be supported by the link member 800. The link member 800 may include a first arm 810, a second arm 820, and a hinge 830. The first arm 810 have a one end rotatably connected to the housing 100'', the second arm 820 may have one end 821 rotatably connected with the first arm 810 through the hinge 830, and the other end 822 may be rotatably connected to the first end 201 of the display 200.

Based on the display 200 being extracted by rotating the rolls 310 and 320, the first arm 810 may be configured to rotate toward a first direction (counterclockwise direction in FIG. 9) around the one end connected with the housing 100, and the second arm 820 may be configured to rotate in a second direction (clockwise direction in FIG. 9) around the one end 821 connected with the first arm 810.

Accordingly, the link member 800 may stably support the rising top frame 210 while the display 200 is being extracted, and when the display 200 is maximally extracted, the link member may be configured to maintain a certain distance between the housing 100 and the top frame 210. In addition, as shown in FIG. 9, the link member 800 may be provided at both side of the rear-surface of the display 200 and to more stably support both edges of the top frame 210.

Additionally, the wiring 410 of the driving circuit 400 which may be disposed to the upper-part or lower-part within the housing 100 may be connected to the one end 201 of the display along the link member 800. Accordingly, even without including a separate device which fixes the wiring 410, based on the wiring 410 being attached and disposed along the link member 800, the driving circuit 400 and the one end 201 of the display 200 may be more easily connected.

Figure 10:
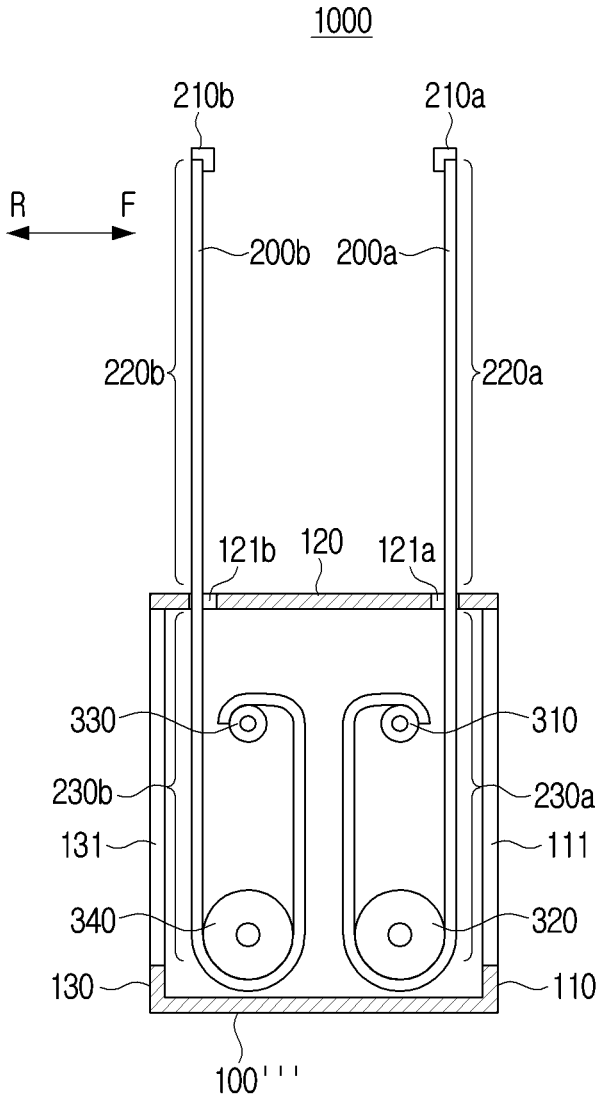
FIG. 10 is a cross-sectional view of a display apparatus having first and second displays according to an embodiment.
Figure 11:
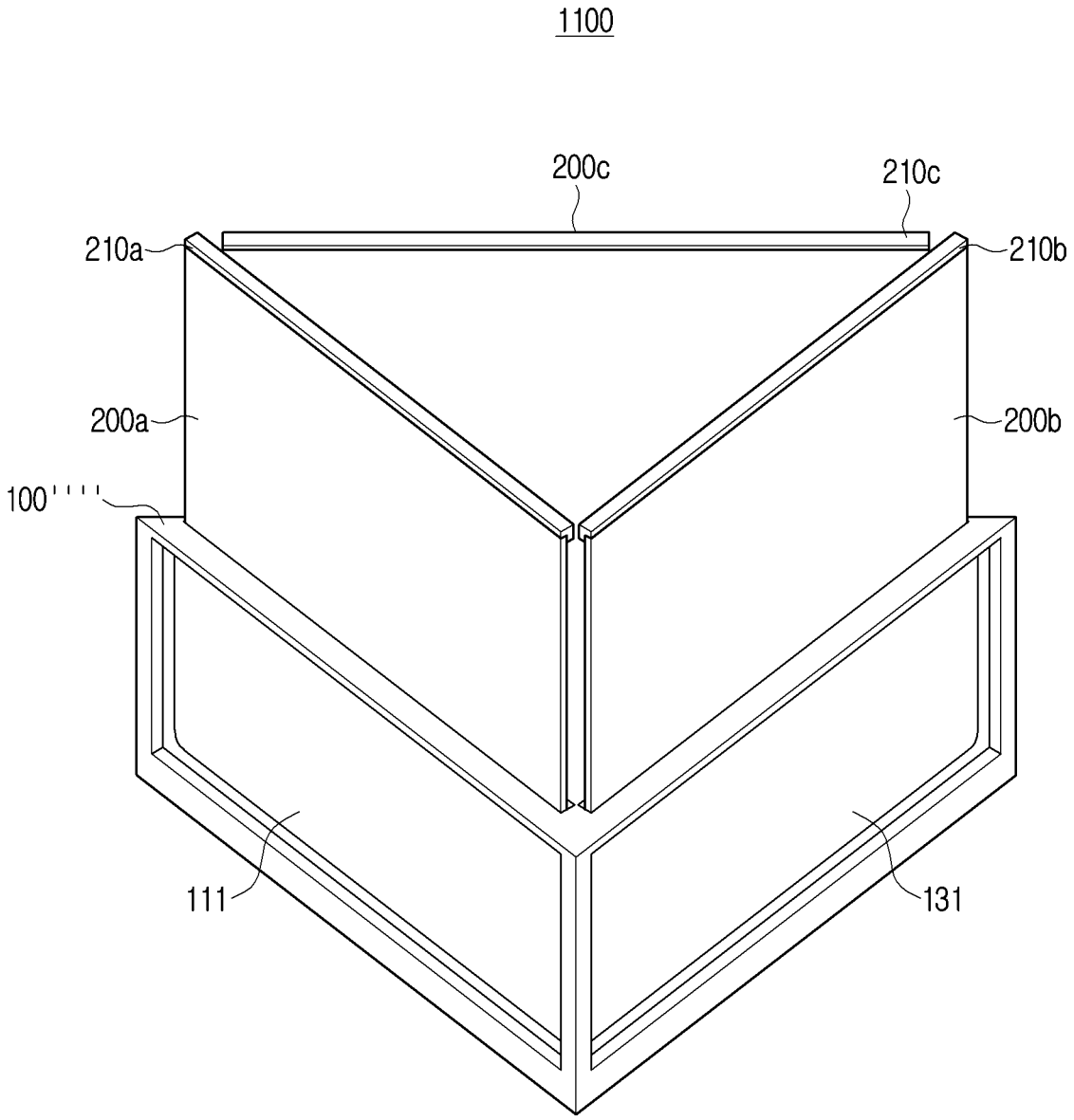
FIG. 11 is a perspective view of a display apparatus according to another embodiment.

FIG. 10 is a cross-sectional view showing a display apparatus 1000 including first and second displays **200*a* and 200*b* according to an embodiment. FIG. 11 is a perspective view showing schematically a display apparatus 1** according to another embodiment.

Referring to FIG. 10, the display apparatus 1000 according to an embodiment may include first to fourth rolls 310, 320, 330 and 340 installed spaced apart within the housing 100''', a first display **200*a* wound around the first and second rolls 310 and 320, and a second display 200*b* wound around the third and fourth rolls 330 and 340**.

The detailed description with respect to configurations and/or structures overlapping with the above-described configurations and/or structures will be omitted, and like reference numerals may be used below.

The first and second displays **200*a* and 200*b* may be extracted from and retracted into the housing 100''' through first and second openings 121*a* and 121*b*, respectively. In addition, the housing 100''' may include a first transparent area 111 and a second transparent area 131 formed so that one area of the first and second displays 200*a* and 200*b*** may be exposed, respectively.

Based on the display apparatus 1000 according to an embodiment additionally including a second display **200*b*, the first display areas 220*a* and 220*b* of the first and second displays 200*a* and 200*b* and the second display area 230*a* and 230*b* may output images of various sizes in a variety of combinations. In particular, a user located at the rear R of the display apparatus 1000 may also view the second display 200*b*** of a wider size.

Referring to FIG. 11, the display apparatus 1100 according to an embodiment may include first to sixth rolls which are spaced apart within a housing 100'''' having a trigonal prism shape, a first display **200*a* which is wound to the first and second rolls, a second display 200*b* which is wound to the third and fourth rolls, and a third display 200*c*** which is wound to the fifth and sixth rolls.

The first to third displays **200*a*, 200*b* and 200*c* may be extracted from and retracted in the housing 100'''' through the first to third openings, respectively. In addition, the housing 100'''' may include first to third transparent areas 111, 131 and one corresponding to display 200*c* which are formed for one area of the first to third displays 200***a*, 200*b* and 200*c* to be exposed, respectively.

Based on the display apparatus 1100 according to an embodiment additionally including the third display 200*c*, the areas exposed through the extracted area and transparent area of the first to third displays 200*a*, 200*b* and 200*c* may output images of various sizes in a variety of combinations. In particular, based on the first to third displays 200*a*, 200*b* and 200*c* which are disposed forming a trigonal prism shape outputting an image, most users that are surrounding the display apparatus 1100 may receive the image output by the display 200 without blind spots.

However, the shape of the housing is not limited thereto, and the number of displays and rolls may be increased if necessary. Accordingly, the shape of the housing may be modified by expanding to a quadrangular prism, a pentagonal prism, a hexagonal prism, or the like.

While the present disclosure has been illustrated and described with reference to various example embodiments thereof, the present disclosure is not limited to the specific embodiments described. It will be understood by those skilled in the art that various changes in form and details may be made therein without departing from the spirit and scope of the disclosure.

What is claimed is:

1. A display apparatus comprising:

a housing provided with an opening;

a first roll and a second roll provided in the housing and spaced apart from each other;

a display configured to be wound around the first roll and the second roll, and to be extracted out from the housing and retracted into the housing through the opening;

a sensor configured to detect at least one of a surrounding illuminance of the display apparatus or a user location; and a processor configured to control the display to display a predetermined image to be exposed through a transparent area based on information detected by the sensor, wherein the housing includes the transparent area configured to expose the display within the housing.

2. The display apparatus of claim 1, wherein the display is further configured to be wound around the first roll and the second roll with an image outputting surface facing outward with respect to the first and second rolls.

3. The display apparatus of claim 1, further comprising:

a driving circuit provided within the housing, wherein the driving circuit is connected to one end of the display through wiring.

4. The display apparatus of claim 3, further comprising:

a link member including:

a first arm rotatably connected to the housing; and a second arm having a first end connected to the display and a second end to rotatably connect to one end of the first arm, wherein the wiring of the driving circuit is disposed along the link member.

5. The display apparatus of claim 1, further comprising:

a driving circuit disposed between the first roll and the second roll, wherein the driving circuit is configured to connect with an end of the display through wiring.

6. The display apparatus of claim 1, wherein the processor is further configured to control the display to output an image at a location corresponding to the transparent area as the display is being retracted into or extracted out from the housing.

7. The display apparatus of claim 1, wherein the transparent area is provided at a portion of a front-surface and a portion of top-surface of the housing.

8. The display apparatus of claim 1, wherein the transparent area is provided by the housing being opened or includes a transparent material.

9. The display apparatus of claim 1, wherein the transparent area includes a first transparent area which is provided at a front-surface of the housing and a second transparent area which is provided at a rear-surface of the housing.

10. The display apparatus of claim 9, wherein the sensor is further configured to detect a wall located behind a rear of the display apparatus, and wherein the processor is further configured to control, based on the sensor detecting the wall, the display to output a color corresponding to an image output toward a front of the display to the second transparent area.

11. The display apparatus of claim 1, further comprising:

a third roll and a fourth roll spaced apart within the housing, wherein the display includes a first display configured to be wound around the first roll and the second roll, and a second display configured to be wound around the third roll and the fourth roll.

12. The display apparatus of claim 11, wherein the transparent area includes a first transparent area configured to expose an area of the first display and a second transparent area configured to expose an area of the second display.

* * * * *